US009915899B2

(12) United States Patent
Yamanaka

(10) Patent No.: US 9,915,899 B2
(45) Date of Patent: Mar. 13, 2018

(54) FIXING DEVICE FOR FIXING TONER IMAGE AND IMAGE FORMING APPARATUS INCLUDING THE SAME

(71) Applicant: KYOCERA Document Solutions Inc., Osaka (JP)

(72) Inventor: Tatsuya Yamanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/597,674

(22) Filed: May 17, 2017

(65) Prior Publication Data

US 2017/0336742 A1 Nov. 23, 2017

(30) Foreign Application Priority Data

May 20, 2016 (JP) ..... 2016-101716

(51) Int. Cl.
*G03G 15/20* (2006.01)

(52) U.S. Cl.
CPC ..... *G03G 15/2053* (2013.01); *G03G 15/2028* (2013.01)

(58) Field of Classification Search
CPC ..... G03G 15/2028; G03G 15/2053
See application file for complete search history.

(56) References Cited

U.S. PATENT DOCUMENTS 5,162,634 A * 11/1992 Kusaka ..... G03G 15/2064 219/216
5,315,356 A * 5/1994 Nagato ..... G03G 15/2064 219/216
5,349,423 A * 9/1994 Nagato ..... G03G 15/2053 219/470
5,379,099 A * 1/1995 Senba ..... G03G 15/2064 399/315
5,402,211 A * 3/1995 Yoshikawa ..... G03G 15/2053 219/216
5,404,214 A * 4/1995 Yoshimoto ..... G03G 15/2064 219/216
5,477,314 A * 12/1995 Tsuchiya ..... G03G 15/657 399/107

(Continued)

FOREIGN PATENT DOCUMENTS

JP 2008-298811 A 12/2008

*Primary Examiner* — David Bolduc
(74) *Attorney, Agent, or Firm* — Stein IP, LLC

(57) ABSTRACT

The fixing device includes a charge elimination member, a retaining member, a contact sheet metal, and a first contact member. The charge elimination member performs charge elimination from a recording medium by making contact with the recording medium that has passed through a fixing-and-nipping part. The retaining member has the charge elimination member fixed thereto. The contact sheet metal is held at a specified potential. The first contact member electrically connects the charge elimination member and the contact sheet metal to each other. The retaining member has a hollow cylindrical-shaped positioning boss, and the fixing housing has an insertion hole into which the positioning boss is to be inserted. The first contact member is placed inside the positioning boss and has one end protruded from the positioning boss. The contact sheet metal is placed so as to face the positioning boss.

7 Claims, 10 Drawing Sheets

(56) References Cited

U.S. PATENT DOCUMENTS 5,579,097 A * 11/1996 Tomoe ..... G03G 15/2064 399/323
5,822,670 A * 10/1998 Morigami ..... G03G 15/2053 399/330
5,974,294 A * 10/1999 Tange ..... G03G 15/2053 219/216
6,173,151 B1 * 1/2001 Ream ..... G03G 15/2064 219/216
2002/0006297 A1 * 1/2002 Ando ..... G03G 15/2053 399/333
2006/0099004 A1 * 5/2006 Hasegawa ..... G03G 15/657 399/92
2006/0182479 A1 * 8/2006 Miyake ..... G03G 15/657 399/400
2006/0257179 A1 * 11/2006 Kim ..... G03G 15/2028 399/322
2007/0147920 A1 * 6/2007 Shimizu ..... B65H 5/38 399/400
2008/0003025 A1 * 1/2008 Tsunoda ..... G03G 15/2028 399/328
2008/0056750 A1 * 3/2008 Kajita ..... G03G 15/2053 399/70
2010/0239338 A1 * 9/2010 Takahashi ..... G03G 15/2053 399/331
2011/0135352 A1 * 6/2011 Takada ..... G03G 15/2053 399/327
2011/0206424 A1 * 8/2011 Tagami ..... G03G 15/2003 399/322
2011/0236090 A1 * 9/2011 Uchiyama ..... G03G 15/2053 399/329
2012/0057887 A1 * 3/2012 Kameda ..... G03G 15/2028 399/44
2012/0082492 A1 * 4/2012 Park ..... G03G 15/6573 399/324
2012/0155912 A1 * 6/2012 Hayase ..... G03G 15/2053 399/90
2012/0308255 A1 * 12/2012 Sakai ..... G03G 15/2053 399/90
2014/0056626 A1 * 2/2014 Sakai ..... G03G 15/2017 399/329
2014/0086644 A1 * 3/2014 Yasuda ..... G03G 15/2028 399/322
2014/0227012 A1 * 8/2014 Honda ..... G03G 15/2028 399/322
2014/0356039 A1 * 12/2014 Sakai ..... G03G 15/2053 399/329

* cited by examiner

FIXING DEVICE FOR FIXING TONER IMAGE AND IMAGE FORMING APPARATUS INCLUDING THE SAME

INCORPORATION BY REFERENCE

This application is based upon and claims the benefit of priority from the corresponding Japanese Patent Application No. 2016-101716 filed on May 20, 2016, the entire contents of which are incorporated herein by reference.

BACKGROUND

The present disclosure relates to a fixing device and an image forming apparatus including the fixing device. More specifically, the disclosure relates to a fixing device having a charge elimination member for performing charge elimination from a recording medium that has passed through a fixing-and-nipping part, as well as to an image forming apparatus including the fixing device.

Conventionally, an electrophotographic type image forming apparatus such as copiers and printers performs a sequential process of: carrying a toner image on a surface of an image carrier such as a photosensitive drum or an intermediate transfer belt; transferring the toner image carried on the surface of the image carrier onto a recording medium; subsequently feeding the recording medium into a fixing device to make the toner image fixed on the recording medium by the fixing device; and thereafter conveying the recording medium to a discharge tray or the like.

The fixing device is equipped with a fixing member made up of a roller and a belt as an example, and a toner image is fixed onto the recording medium by this fixing member. In this case, since a recording medium onto which the toner image is to be fixed by the fixing member bears electric charges thereon, electric charges are deposited and accumulated on the surface of the fixing member each time a fixing operation is repeated.

Under such circumstances, there has been known an image forming apparatus in which a charge elimination member is provided on a downstream side of a fixing-and-nipping part, where the charge elimination member is put into contact with a portion of the recording medium that has passed through the fixing-and-nipping part so as to fulfill charge elimination from the recording medium as well as charge elimination also from the fixing member via the recording medium. Such an image forming apparatus has a need for maintaining the charge elimination member at a specified potential. For this reason, a contact sheet metal which is maintained at a specified potential is provided in a fixing housing, where the charge elimination member and the contact sheet metal are electrically connected to each other by a contact member.

SUMMARY

A fixing device according to a first aspect of the disclosure includes a fixing member, a fixing housing, a charge elimination member, a retaining member, a contact sheet metal, and a first contact member. The fixing member includes a heating member and a pressure member to be put into pressure contact with the heating member, and the fixing member serves for heating and pressurizing a toner image carried on a recording medium to make the toner image fixed on the recording medium. The fixing housing houses the fixing member therein. The charge elimination member is placed on a downstream side of the fixing member in a recording-medium conveyance direction, and serves for charge elimination from the recording medium by making contact with the recording medium that has passed through a fixing-and-nipping part formed of the heating member and the pressure member. The retaining member, to which the charge elimination member is fixed, is mounted on the fixing housing. The contact sheet metal is fixed to the fixing housing and held at a specified potential. The first contact member electrically connects the charge elimination member and the contact sheet metal to each other. The retaining member has a positioning boss for mounting the retaining member onto the fixing housing. The fixing housing has an insertion hole into which the positioning boss is to be inserted. The positioning boss is formed into a hollow cylindrical shape. The first contact member is placed inside the positioning boss and has one end protruded from a distal end of the positioning boss. The contact sheet metal is placed so as to be opposed to the distal end of the positioning boss.

Still further objects of the disclosure as well as concrete advantages obtained by the disclosure will become more apparent from an embodiment thereof described hereinbelow.

DETAILED DESCRIPTION

Hereinbelow, an embodiment of the present disclosure will be described with reference to the accompanying drawings.

Figure 1:
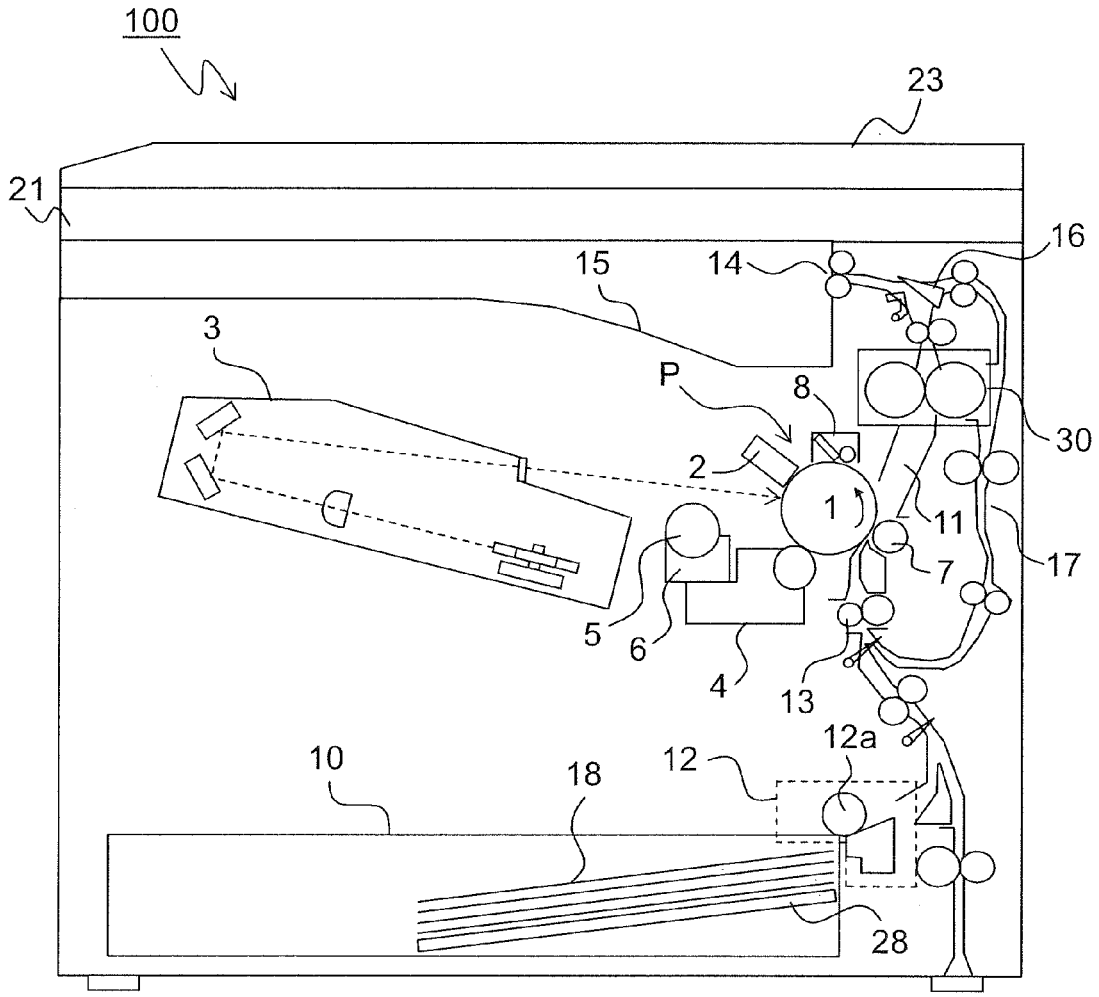
FIG. 1 is a sectional view showing an overall configuration of an image forming apparatus including a fixing device according to one embodiment of the present disclosure.

As shown in FIG. 1, an image forming part P for forming a monochrome image through charging, light exposure, development and transfer steps is set up in a main body of an image forming apparatus 100. In this case, the image forming apparatus 100 is exemplified by a monochrome multifunction peripheral.

In the image forming part P, a charging device 2, an exposure unit 3, a developing device 4, a transfer roller 7, a cleaning device 8, and a charge eliminating device (not shown) are disposed along a rotational direction of a photosensitive drum 1 (a counterclockwise direction of FIG. 1). In the image forming part P, an image formation process for the photosensitive drum 1 is executed while the photosensitive drum 1 is being rotated counterclockwise as in FIG. 1.

The photosensitive drum 1, which is formed by stacking a photosensitive layer on a surface of an aluminum drum as an example, is to be electrically charged at its surface by the charging device 2. Then, a laser beam derived from the later-described exposure unit 3 is applied to the surface of the photosensitive drum 1, by which an electrostatic latent image with its charged level attenuated is formed.

The charging device 2 electrically charges the surface of the photosensitive drum 1 uniformly. The exposure unit 3 irradiates the photosensitive drum 1 with an optical beam (e.g., laser beam) on a basis of document image data read in an image reading part 21, by which an electrostatic latent image is formed on the surface of the photosensitive drum 1.

The developing device 4 makes toner stuck to the electrostatic latent image of the photosensitive drum 1 to form a toner image. Toner supply to the developing device 4 is carried out from a toner container 5 via an intermediate hopper 6. In this case, a one-component developer (hereinafter, also referred to simply as toner), which is composed of only a toner component having magnetic property is housed in the developing device 4.

The transfer roller 7 transfers the toner image formed on the surface of the photosensitive drum 1 onto a sheet of paper (recording medium) conveyed up along a sheet conveyance path 11 while the toner image remains undisturbed. The cleaning device 8, which is equipped with a cleaning roller, a cleaning blade or the like to be put into line contact with the photosensitive drum 1 in its longitudinal direction, eliminates residual toner remaining on the surface of the photosensitive drum 1 after the toner image has been transferred onto the sheet.

The image reading part 21 is composed of: a scanning optical system in which a scanner lamp for illuminating a document in copying process and a mirror for changing an optical path of reflected light from the document are mounted; a condenser lens for condensing reflected light from the document to form an image; a CCD sensor for converting the image light of the formed image into electrical signals; and the like (none of these component members are shown). The image reading part 21 reads a document image and converts the image into image data.

A sheet feed cassette 10 for containing sheets 18 of paper is placed in lower part of the main body of the image forming apparatus 100. The sheet feed cassette 10 is provided with a sheet stacking plate 28 on which the sheets 18 are to be stacked. The sheet stacking plate 28 is so structured that its sheet-feed-direction downstream side (right side in FIG. 1) is up/down movable while a swing shaft (not shown) located on the sheet-feed-direction upstream side serves as a fulcrum.

For copying process, image data of the document is converted to a read image signal in the image reading part 21. Meanwhile, in the image forming part P, the photosensitive drum 1, which rotates counterclockwise in FIG. 1, is uniformly electrically charged by the charging device 2, and the exposure unit 3 applies a laser beam (ray of light) onto the photosensitive drum 1 on the basis of the document image data read by the image reading part 21, by which an electrostatic latent image based on the image data is formed on the surface of the photosensitive drum 1. Thereafter, the developing device 4 makes toner stuck to the electrostatic latent image, thereby forming a toner image.

Toward the image forming part P in which the toner image has been formed as described above, a sheet 18 is fed out from the sheet feed cassette 10 by a sheet feed device (sheet feed/conveyance device) 12 having a sheet feed roller 12*a*. Via the sheet conveyance path 11 and a registration roller pair 13, the sheet 18 is conveyed to the image forming part P at a specified timing. Then, in the image forming part P, the toner image on the surface of the photosensitive drum 1 is transferred onto the sheet 18 by the transfer roller 7. The sheet 18, on which the toner image has been transferred, is separated from the photosensitive drum 1 and conveyed to a fixing device 30 so as to be heated and pressurized, by which the toner image is fixed on the sheet 18.

The sheet 18, which has passed through the fixing device 30, is sorted in conveyance direction by a branch part 16 branched into a plurality of directions. When image formation is applied only to one side of the sheet 18, the sheet 18 is discharged, as it is, to a discharge tray 15 by a discharge roller pair 14.

On the other hand, when image formation is applied to both sides of the sheet 18, the sheet 18, which has passed through the fixing device 30, is once conveyed toward the discharge roller pair 14. After a rear end of the sheet 18 has passed through the branch part 16, the discharge roller pair 14 is rotated reverse while the conveyance direction of the branch part 16 is switched over, so that the sheet 18 is distributed, starting with its rear end, to a reverse conveyance path 17, by which the sheet 18 is reconveyed to the registration roller pair 13 with the image-formed surface of the sheet 18 reversed. Then, a succeeding image formed on the photosensitive drum 1 is transferred onto an image-unformed surface of the sheet 18 by the transfer roller 7. The sheet 18 is then conveyed to the fixing device 30, where a toner image is fixed, the sheet 18 thereafter being discharged to the discharge tray 15.

Figure 2:
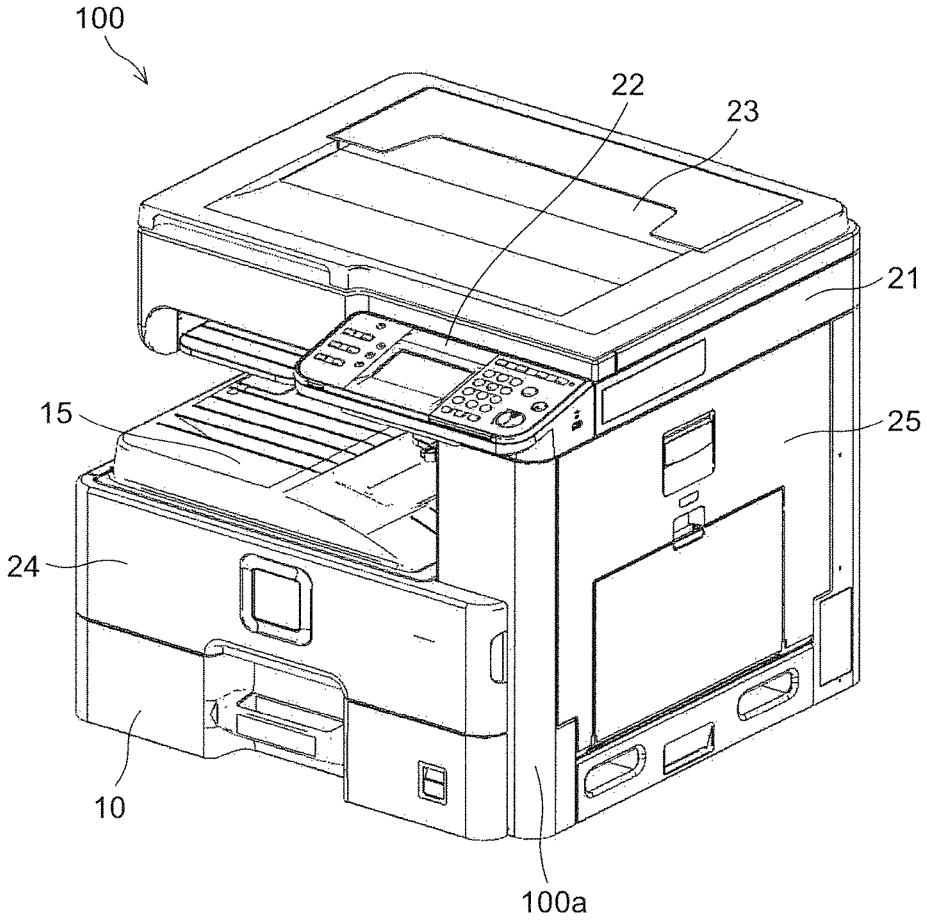
FIG. 2 is an appearance perspective view of the image forming apparatus including the fixing device according to one embodiment of the disclosure.

As shown in FIG. 2, on top of the image reading part 21, a document setting base (not shown) with a transparent glass plate (contact glass) attached thereto, and an operation panel 22 protruded on the front face side (viewer side in FIG. 1) of the main body of the image forming apparatus 100, are disposed. Also on top of the image reading part 21, a platen (document holder) 23 for holding a document set on the document setting base is supported so as to be openable and closable.

Figure 3:
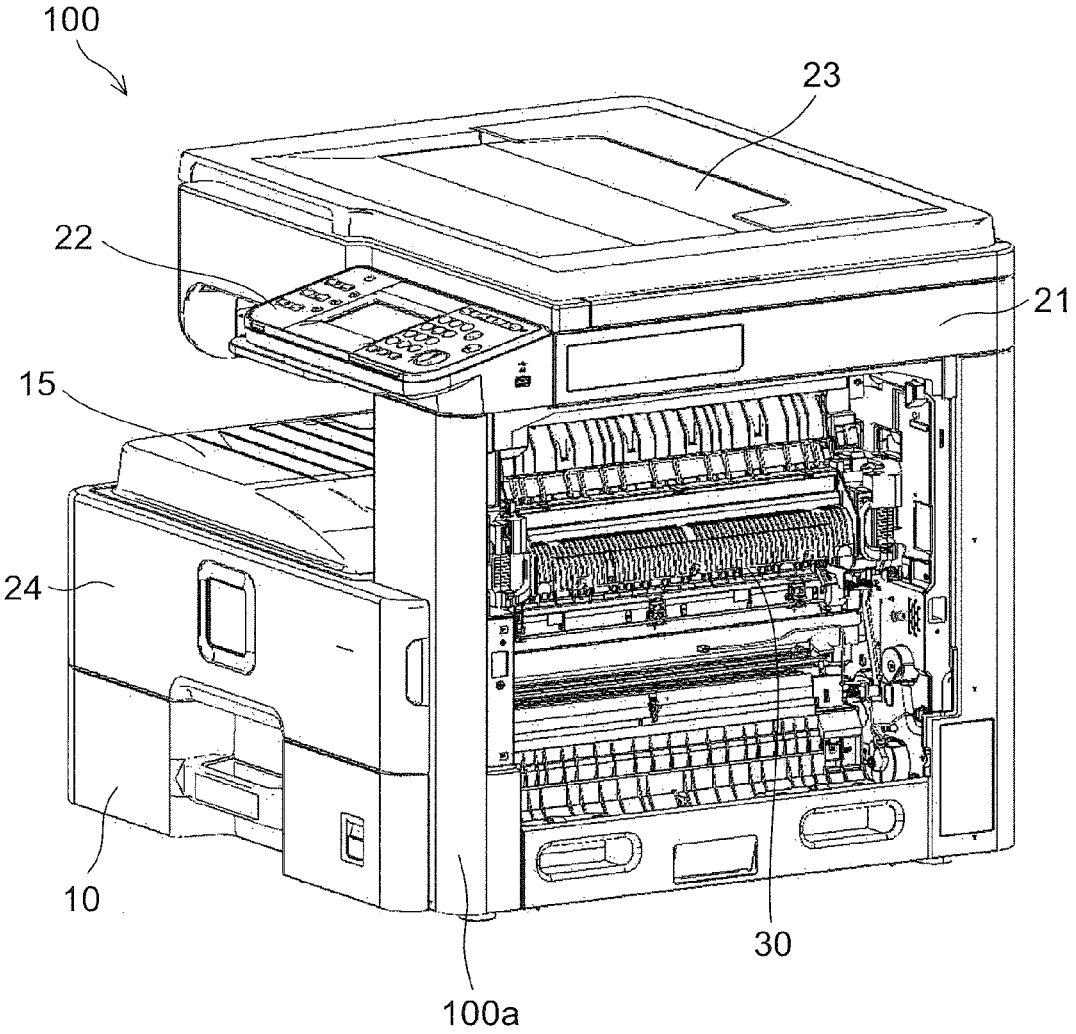
FIG. 3 is an appearance perspective view of the image forming apparatus including the fixing device according to one embodiment of the disclosure, showing a state in which a side cover has been removed.

On a front face side of a housing 100*a*, a front cover 24 is provided openable and closable. Opening this front cover 24 allows individual members within the housing 100*a* to be treated for maintenance and replacement. Also, a side cover 25 is provided openable and closable on a right side face of the housing 100*a*. Opening this side cover 25 causes the fixing device 30 and the like to be exposed as shown in FIG. 3.

Figure 4:
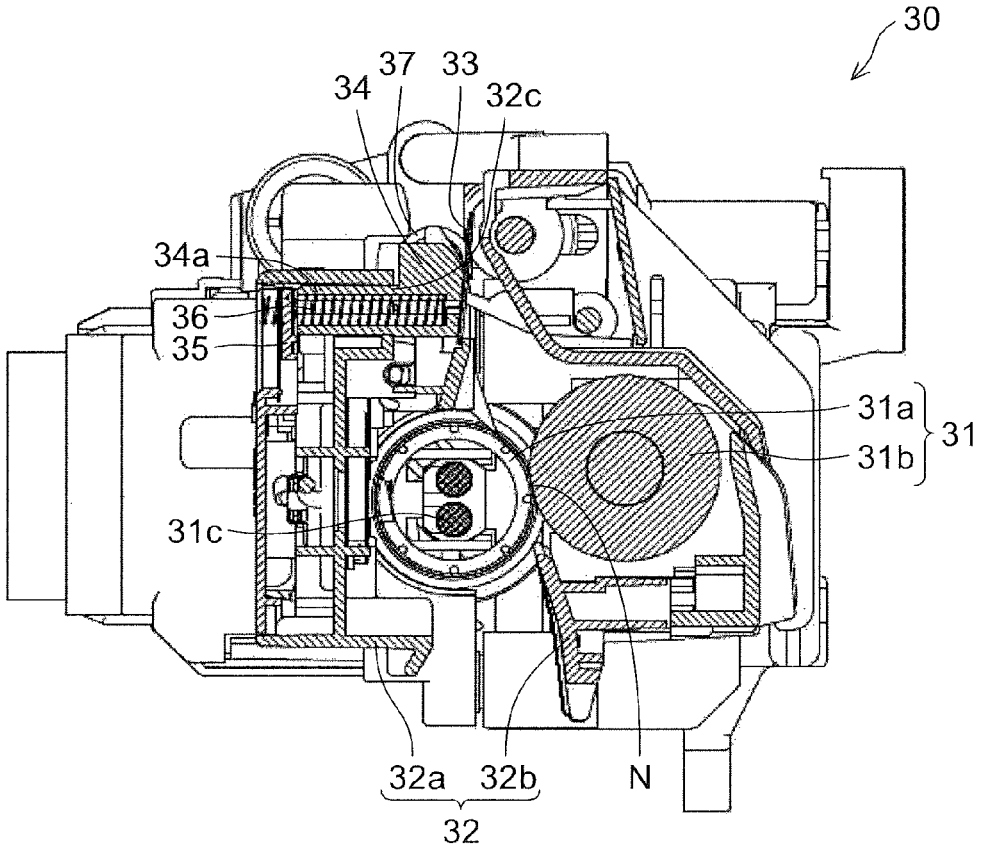
FIG. 4 is a sectional view showing a structure of the fixing device according to one embodiment of the disclosure.

As shown in FIG. 4, the fixing device 30, which is the thermal roller fixing type, includes a fixing roller pair (fixing member) 31 composed of a heating roller 31*a* as a heating member and a pressure roller 31*b* as a pressure member, and a fixing housing 32 (see also FIGS. 5 and 6) for housing the fixing roller pair 31 therein.

A heater 31*c*, which is a heat source, is placed inside a core metal of the heating roller 31*a*.

The fixing housing 32, which is formed from resin, is composed of an inner housing 32*a* placed inside the image forming apparatus 100, and an outer housing 32*b* placed outside the image forming apparatus 100. The heating roller 31*a* that rotates counterclockwise in FIG. 4 is housed in the inner housing 32*a*, and the pressure roller 31*b* that rotates clockwise in FIG. 4 is housed in the outer housing 32*b*. The pressure roller 31*b* is set in pressure contact with the heating roller 31*a* at a specified pressure by an unshown biasing member. The heating roller 31*a* and the pressure roller 31*b* act to fix unfixed toner on a sheet 18 passing through a fixing-and-nipping part N.

Figure 7:
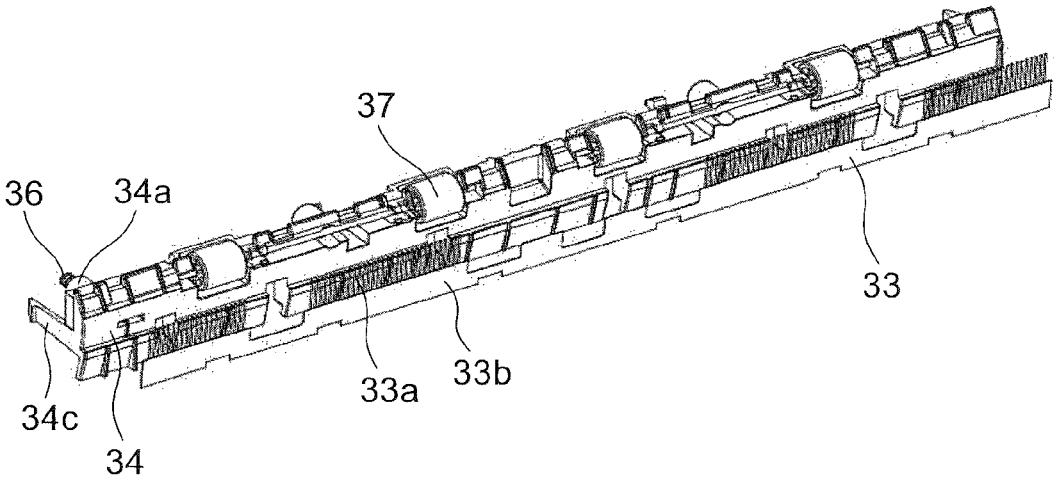
FIG. 7 is a perspective view showing a structure of a charge elimination member and a retaining member in the fixing device according to one embodiment of the disclosure, showing a state prior to mounting of the charge elimination member onto the retaining member.
Figure 8:
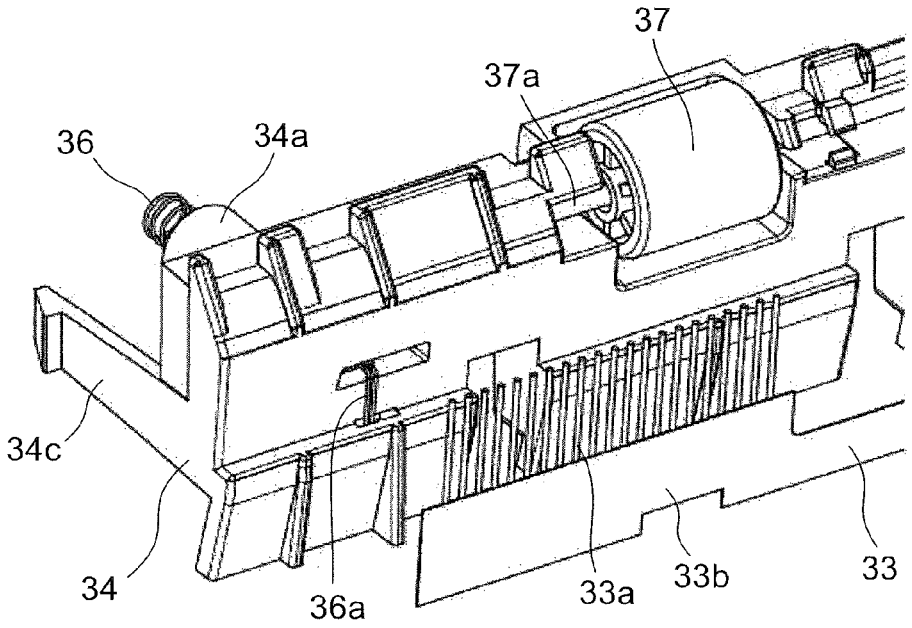
FIG. 8 is a partial enlarged view of FIG. 7.
Figure 9:
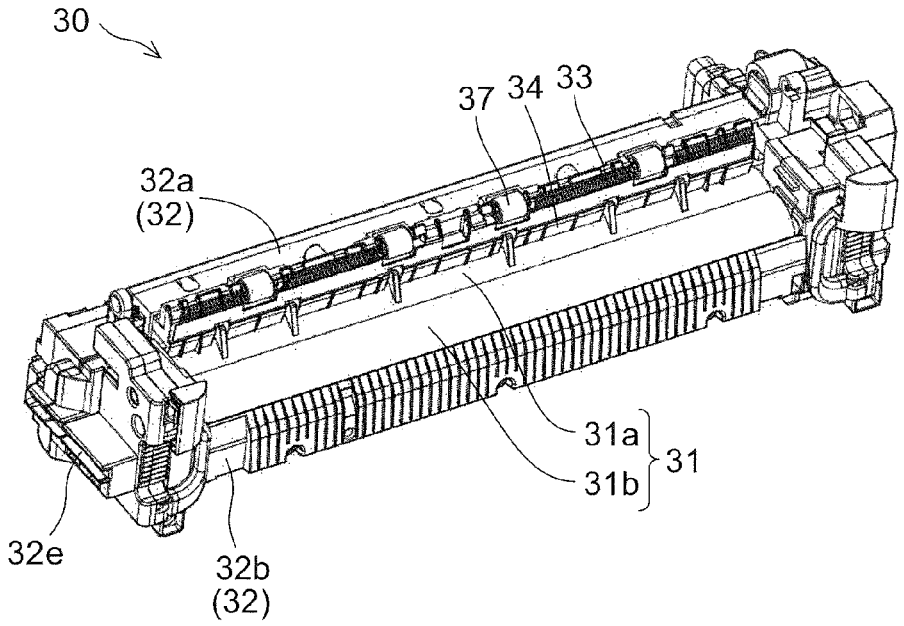
FIG. 9 is a perspective view showing the structure of the fixing device according to one embodiment of the disclosure, showing a state in which upper part of the outer housing has been removed.

An electrically conductive charge elimination member 33 which makes contact with the sheet 18 that has passed through the fixing-and-nipping part N is provided on a downstream side of the fixing roller pair 31 as viewed in the sheet conveyance direction. By the charge elimination member 33 making contact with the sheet 18, the sheet 18 is subjected to charge elimination while the fixing roller pair 31 also undergoes charge elimination via the sheet 18. As shown in FIGS. 7 and 8, the charge elimination member 33, which is formed into a comb-like shape, is composed of a brush portion 33*a* including a multiplicity of brush bristles extending in parallel to one another, and a body portion 33*b* for supporting the brush portion 33*a*. The brush portion 33*a* and the body portion 33*b* may be formed either by machining (etching process or the like) of one metal plate or by combining separate members together. Also, the charge elimination member 33, as shown in FIGS. 9 and 10, is bonded to a retaining member 34 with a double-sided tape or the like (not shown) and moreover fixed to the inner housing 32*a* via the retaining member 34.

As shown in FIG. 4, the retaining member 34, which is placed on the downstream side (upper side in FIG. 4) of the fixing-and-nipping part N as viewed in the sheet conveyance direction, serves also as a guide member for guiding the sheet 18 that has passed through the fixing-and-nipping part N. Also, the retaining member 34 is formed so as to extend in a sheet widthwise direction (a direction perpendicular to the drawing sheet of FIG. 4), and rotatably supports a rotating shaft 37*a* (see FIG. 8) of plural conveyance rollers 37 placed on the downstream side of the fixing-and-nipping part N in the sheet conveyance direction. In addition, part of the brush portion 33*a* of the charge elimination member 33 is inserted into a gap between the rotating shaft 37*a* and the retaining member 34 (under the rotating shaft 37*a*) so as to be in contact with the rotating shaft 37*a* (see FIG. 15).

Figure 10:
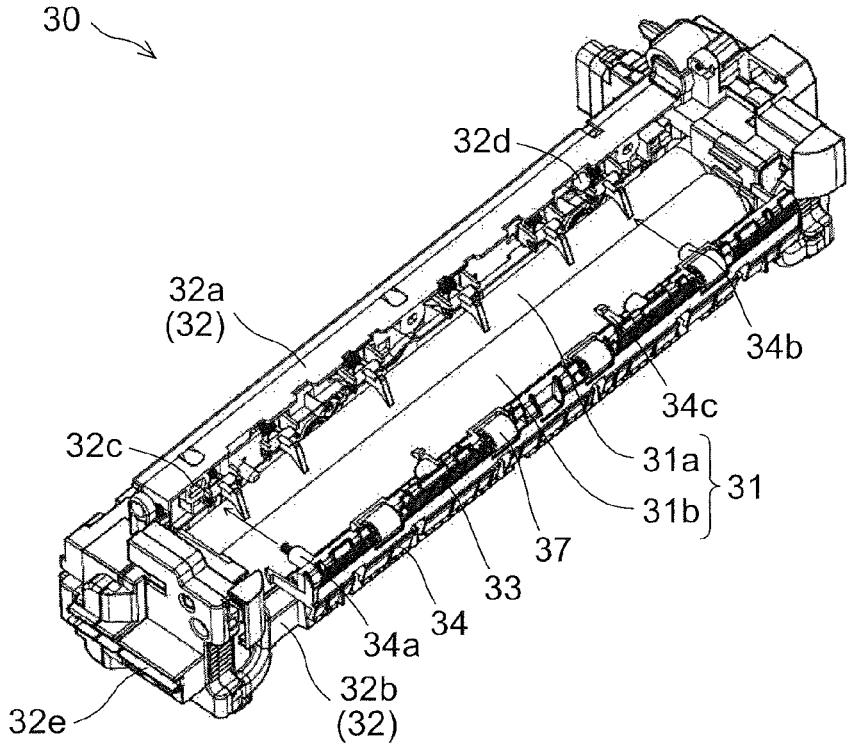
FIG. 10 is a perspective view showing the structure of the fixing device according to one embodiment of the disclosure, with upper part of the outer housing removed, showing a state prior to mounting of the retaining member onto the inner housing.

As shown in FIG. 10, on longitudinal one side of the retaining member 34 (left side in FIG. 10) and the other side (right side in FIG. 10) thereof, positioning bosses 34*a* and 34*b* are formed, respectively, so as to be protruded on one side (left side in FIG. 10) opposite to one side opposite to the sheet conveyance path 11 side. As shown in FIG. 4, the positioning boss 34*a* is formed into a hollow cylindrical shape. Also, in the retaining member 34, as shown in FIG. 10, a plurality (four in this case) of snap-fit shaped engaging claws 34c to be engaged with the inner housing 32*a* are formed.

In the inner housing 32*a*, insertion holes 32*c* and 32*d* into which the positioning bosses 34*a* and 34*b*, respectively, are to be inserted are formed. The insertion hole 32*d* is formed into a circular shape, and the insertion hole 32*c* is formed into an elliptical shape which is a little longer in the longitudinal direction of the retaining member 34.

As shown in FIG. 4, a contact sheet metal 35 to be held at a specified potential is fixed at a portion of the inner housing 32*a* facing the insertion hole 32*c* (a portion facing the positioning boss 34*a*). The contact sheet metal 35 is formed so as to extend in a direction along the sheet conveyance direction (in the up/down direction) and moreover to be longer than an adjustment width of a later-described adjustment mechanism 60 in the up/down direction. In addition, the contact sheet metal 35 is placed at a one-end-side portion of the fixing device 30 (left side in FIG. 5).

Between the contact sheet metal 35 and the charge elimination member 33, a first contact member 36 for electrically connecting the contact sheet metal 35 and the charge elimination member 33 to each other is placed. The first contact member 36, which is a coil spring, is placed in the positioning boss 34*a* and has one end protruded from a distal end of the positioning boss 34*a*. Therefore, when the positioning boss 34*a* of the retaining member 34 is inserted into the insertion hole 32*c* of the inner housing 32*a*, the first contact member 36 is brought into contact with the contact sheet metal 35.

Figure 11:
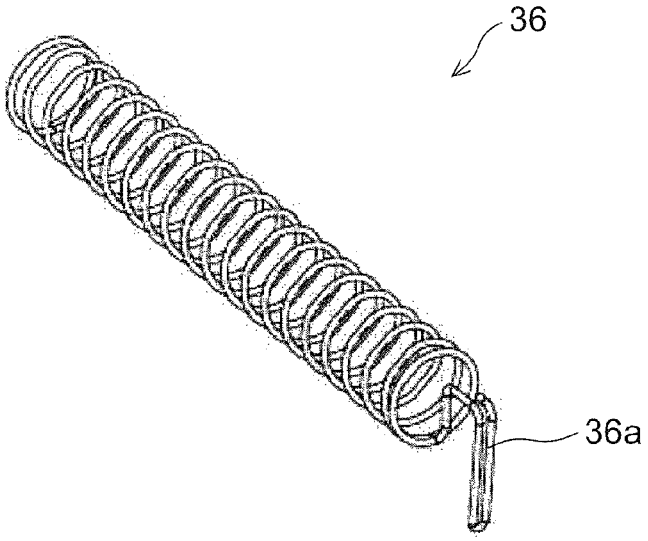
FIG. 11 is a perspective view showing a structure of a first contact member of the fixing device according to one embodiment of the disclosure.

As shown in FIGS. 8 and 11, an end portion 36*a* of the first contact member 36 on one side closer to the charge elimination member 33 is protruded outward from the retaining member 34 and moreover bent in a direction crossing a protruding direction of the positioning boss 34*a*. Therefore, after the end portion 36*a* is protruded outward from the retaining member 34, the first contact member 36 is turned, by which the end portion 36*a* is engaged with an outer surface of the retaining member 34. In this state, the charge elimination member 33 is fixed to the retaining member 34, thereby making the end portion 36*a* of the first contact member 36 brought into contact with the charge elimination member 33. Thus, the charge elimination member 33 and the contact sheet metal 35 can be electrically connected to each other.

Figure 5:
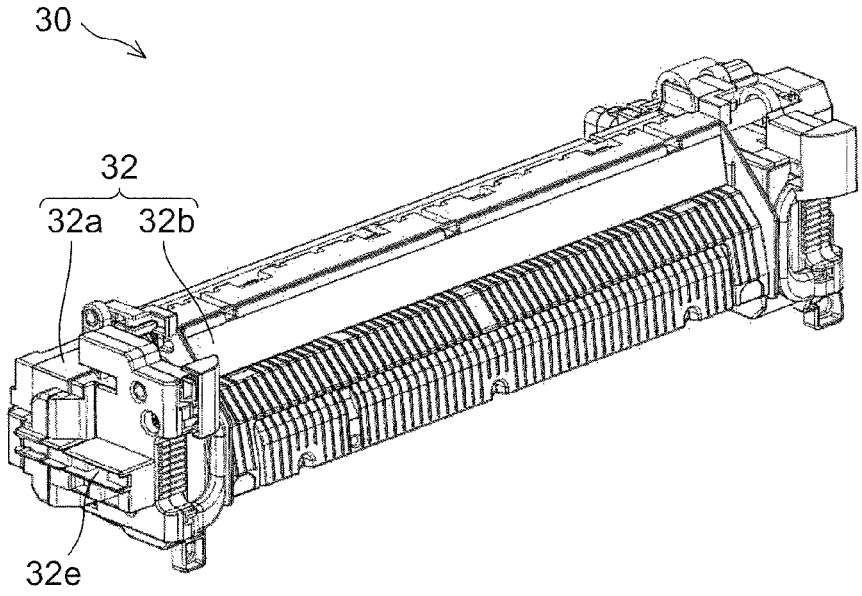
FIG. 5 is a perspective view of the structure of the fixing device according to one embodiment of the disclosure, as viewed from an outer housing side.
Figure 6:
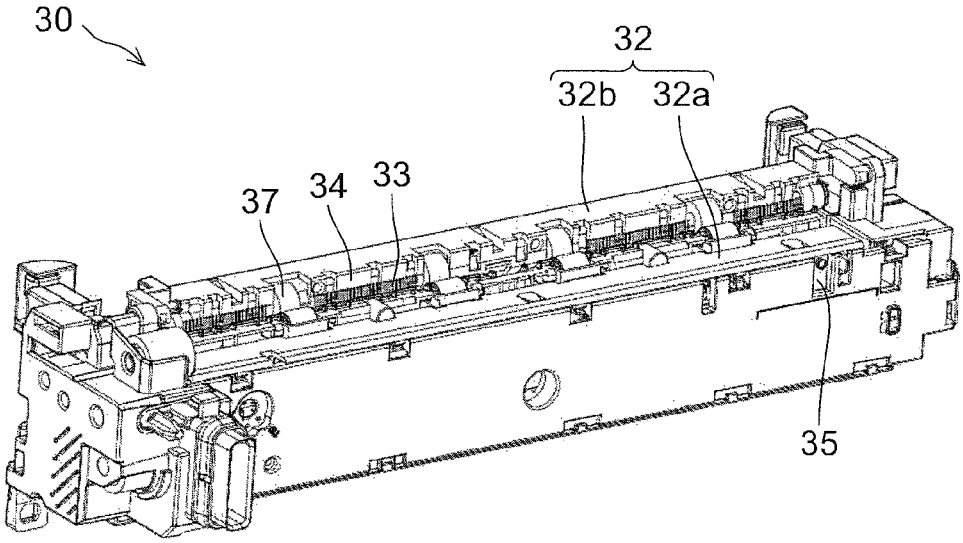
FIG. 6 is a perspective view of the structure of the fixing device according to one embodiment of the disclosure, as viewed from an inner housing side.

Also as shown in FIG. 5, an engaging portion 32*e* to be engaged with a later-described support member 61 of the adjustment mechanism 60 is formed at a one-side end portion of the fixing housing 32 (left-side end portion in FIG. 5).

Figure 12:
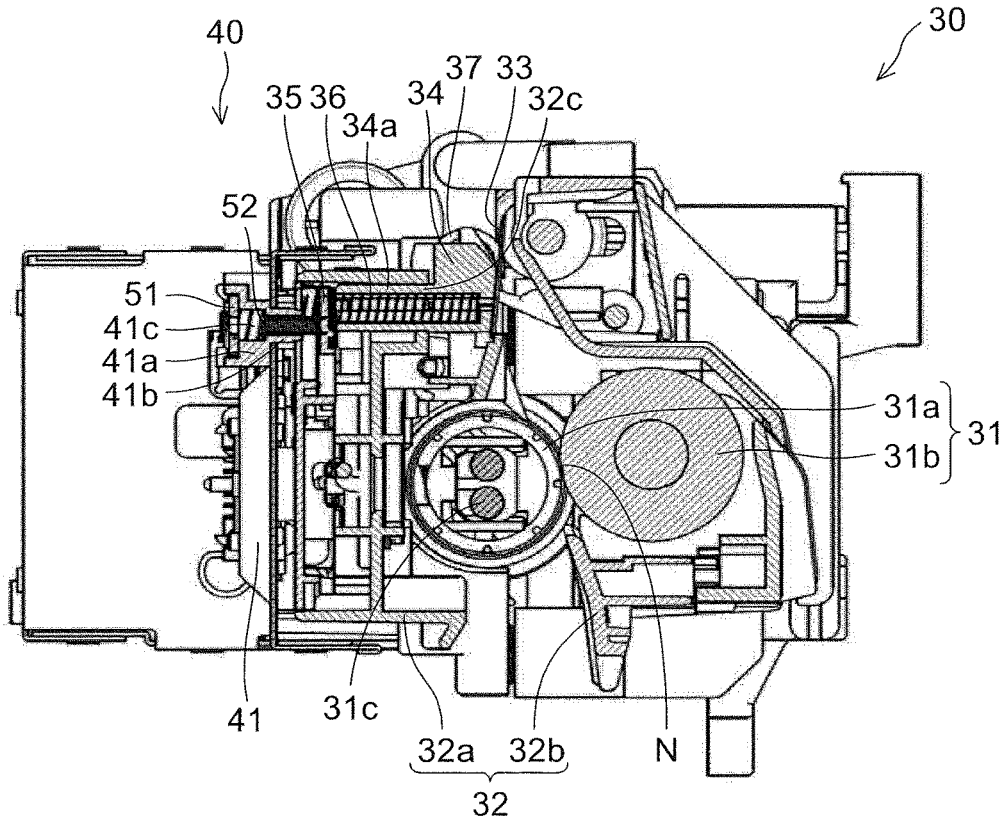
FIG. 12 is a sectional view showing a state in which the fixing device according to one embodiment of the disclosure is mounted on a mounting member.
Figure 13:
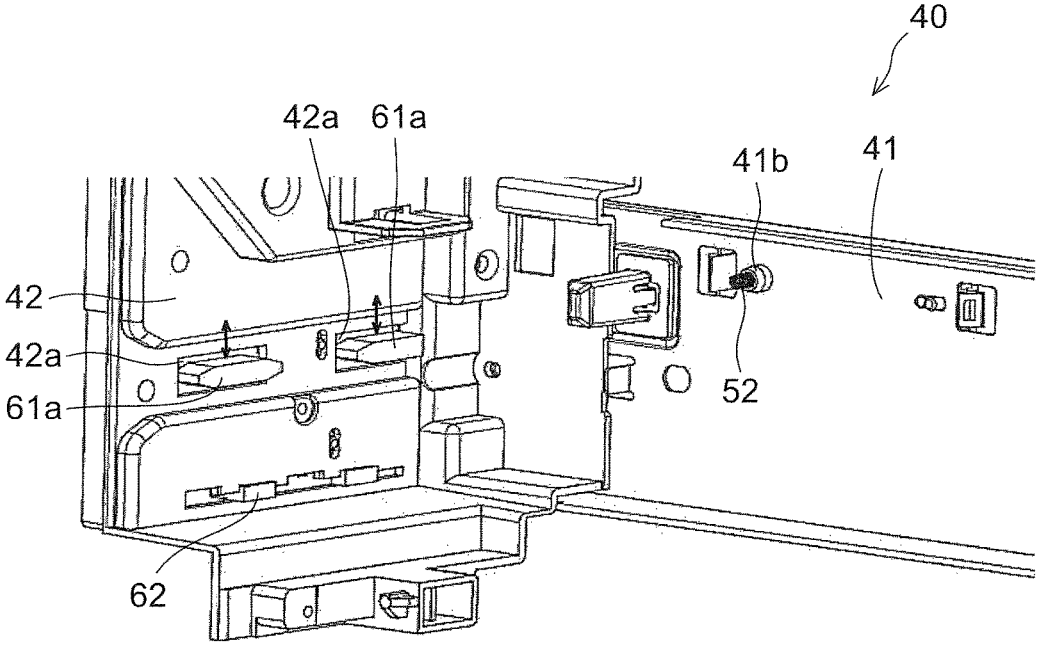
FIG. 13 is a perspective view showing a structure of the mounting member of the image forming apparatus according to one embodiment of the disclosure, as viewed from the fixing device side.

A mounting member 40 on which the fixing device 30 is to be mounted is provided in the main body of the image forming apparatus 100 as shown in FIG. 12. The mounting member 40, as shown in FIG. 13, has a front portion 41 extending in the longitudinal direction of the fixing device 30, and side portions 42 placed at both end portions of the fixing device 30, respectively.

Figure 14:
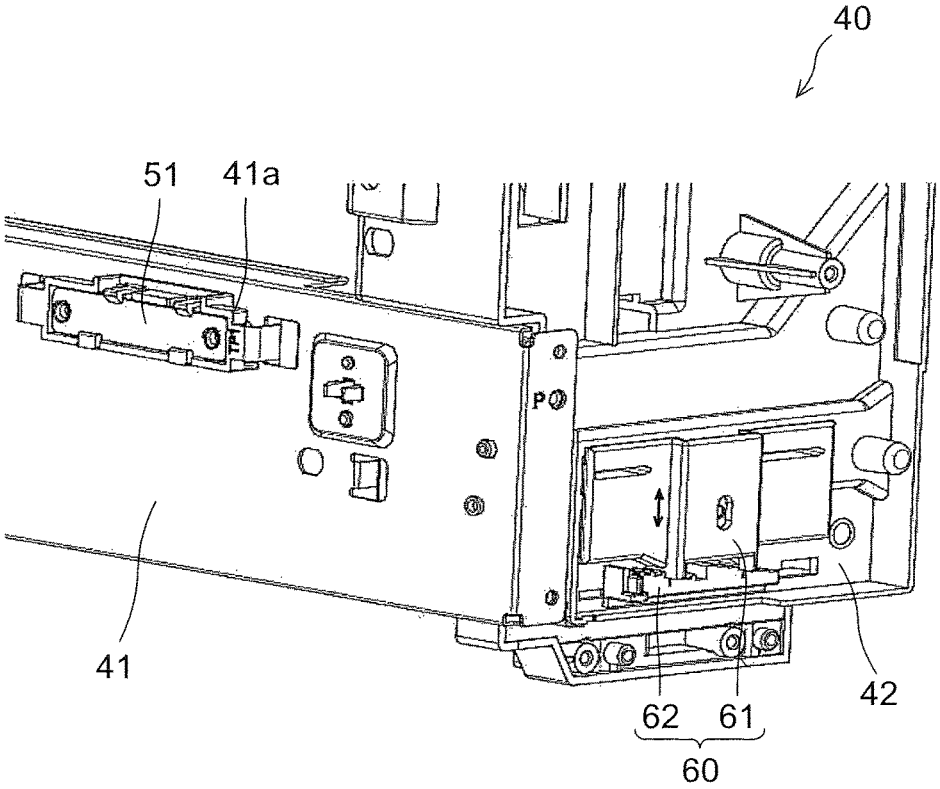
FIG. 14 is a perspective view of the structure of the mounting member of the image forming apparatus according to one embodiment of the disclosure, as viewed from one side opposite to the fixing device side.
Figure 15:
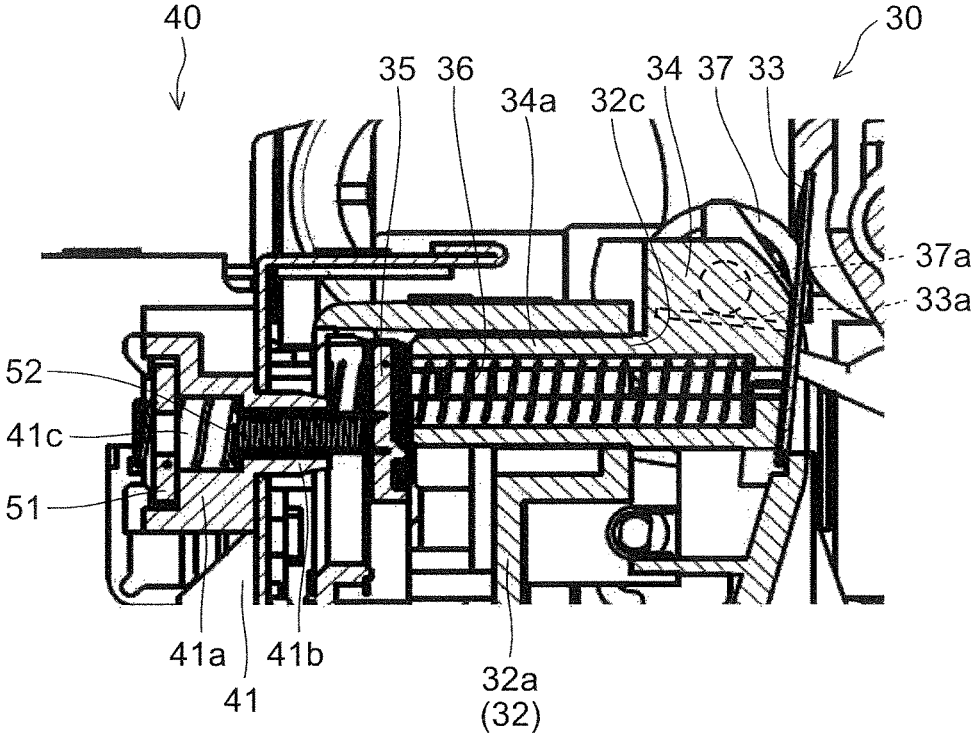
FIG. 15 is a partial enlarged view of FIG. 12.

As shown in FIGS. 14 and 15, on one surface of the front portion 41 opposite to the fixing device 30 side, a fixing portion 41*a* is formed to which a board 51 with a Zener diode 51*a* attached thereto (see FIG. 16) is to be fixed. On the fixing device 30-side surface of the front portion 41, as shown in FIGS. 13 and 15, a boss 41*b* protruded on the fixing device 30 side is formed. The fixing portion 41*a* and the boss 41*b* are interconnected by a through hole 41*c*.

Figure 16:
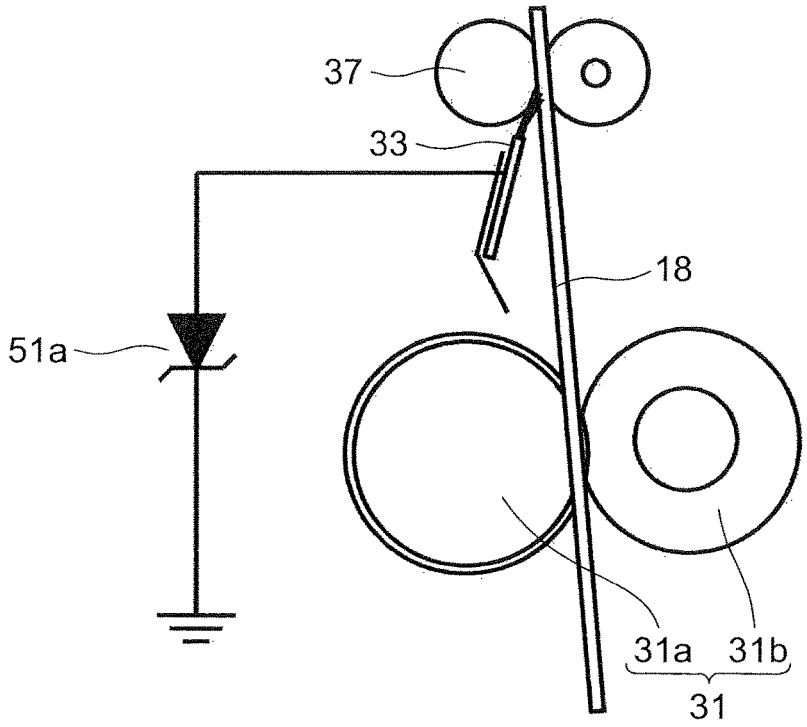
FIG. 16 is a simplified view of a state in which the charge elimination member of the fixing device according to one embodiment of the disclosure is electrically connected to the ground via a Zener diode.

Inside the through hole 41*c*, a second contact member 52 formed of a coil spring is placed so as to be in contact with the board 51 and electrically connected to the ground via the Zener diode 51*a* (see FIG. 16). A fixing device 30-side end portion of the second contact member 52 is protruded outward from the boss 41*b*. The boss 41*b* is provided at a position facing the contact sheet metal 35 of the fixing device 30. With the fixing device 30 mounted on the mounting member 40, the second contact member 52 is in contact with the contact sheet metal 35 of the fixing device 30, so that the contact sheet metal 35 and the board 51 are electrically connected to each other. Accordingly, as shown in FIG. 16, the charge elimination member 33 is electrically connected to the ground via the Zener diode 51*a* so as to be held at a specified potential.

As shown in FIG. 14, the adjustment mechanism 60 for moving one end portion of the fixing device 30 relative to the mounting member 40 in a direction along the sheet conveyance direction (in the up/down direction) is provided in one side portion 42 placed facing the one end portion of the fixing device 30. Moving one end portion of the fixing device 30 by the adjustment mechanism 60 in the up/down direction allows the mounting angle of the fixing device 30 to the mounting member 40 to be adjusted, so that the posture of the sheet 18 passing through the fixing device 30 can be adjusted.

In more detail, the adjustment mechanism 60 is composed of the support member 61 displaceable (movable) in the up/down direction, and a step gap member 62 placed under the support member 61 and having a stepwise upper surface. In the support member 61, as shown in FIG. 13, engaging protrusions 61*a* are formed so as to be protruded toward the fixing device 30 side via openings 42*a* of the side portion 42 and to be vertically (up/down direction) engageable with the engaging portion 32*e* (see FIG. 5) of the fixing device 30.

The step gap member 62 is formed so as to be displaceable (movable) in a horizontal direction. Moving the step gap member 62 in the horizontal direction allows the support member 61 to be changed in vertical position. As a result, the mounting angle of the fixing device 30 relative to the mounting member 40 can be adjusted by displacing one end portion of the fixing device 30 vertically (in the up/down direction).

In this embodiment, as described above, the first contact member 36 that electrically connects the charge elimination member 33 and the contact sheet metal 35 to each other is placed inside the positioning boss 34*a* of the retaining member 34 and has one end protruded from a distal end of the positioning boss 34*a*, whereas the contact sheet metal 35 is placed so as to face the distal end of the positioning boss 34*a*. As a result of this, positional shifts of the first contact member 36 can be suppressed so that the first contact member 36 can securely be electrically connected to the contact sheet metal 35. Thus, deterioration of the image quality can be suppressed.

Also, since the first contact member 36 is placed inside the positioning boss 34*a* of the retaining member 34, it is necessary neither to ensure a space for placing therein the first contact member 36 nor to increase the scale of the fixing device 30.

Further, as described above, the charge elimination member 33 is in contact with the rotating shaft 37*a* of the conveyance rollers 37. As a result of this, charge elimination for the conveyance rollers 37 can also be fulfilled. Therefore, a possibility that toner which has just undergone fixing process and which has not yet been cooled and solidified may stick to the conveyance rollers 37 or another that paper dust may stick to the conveyance rollers 37 can be suppressed.

Also as described above, the charge elimination member 33-side end portion 36*a* of the first contact member 36 is protruded outward from the retaining member 34 and moreover bent in a direction crossing the protruding direction of the positioning boss 34*a*. As a result of this, the first contact member 36 can be made more easily contactable with the charge elimination member 33, and the possibility that the end portion 36*a* of the first contact member 36 may intrude into the positioning boss 34*a* can be suppressed.

Also as described above, the retaining member 34 serves also as a guide member for guiding the sheet 18 that has passed through the fixing-and-nipping part N. Since the sheet 18 is conveyed along the guide member (retaining member 34), the charge elimination member 33 mounted on the retaining member 34 can reliably be brought into contact with the sheet 18.

Also as described above, the contact sheet metal 35 is formed so as to be longer than the adjustment width of the adjustment mechanism 60 in the direction extending along the sheet conveyance direction (up/down direction). As a result of this, even when the mounting angle of the fixing device 30 to the mounting member 40 is adjusted by using the adjustment mechanism 60 in order to adjust the posture of the sheet 18 passing through the fixing device 30, the second contact member 52 can reliably be brought into contact with the contact sheet metal 35.

Also as described above, in process of adjusting the mounting angle of the fixing device 30 to the mounting member 40, one end portion of the fixing device 30 is moved relative to the mounting member 40 in the up/down direction. Therefore, in the case where the contact sheet metal 35 is placed at a one-end-side portion of the fixing device 30, the second contact member 52 tends to be less easily contactable with the contact sheet metal 35. From this point of view, with the contact sheet metal 35 placed at a one-end-side portion of the fixing device 30, it is particularly effective to form the contact sheet metal 35 longer in the up/down direction than the adjustment width of the adjustment mechanism 60.

The embodiment disclosed herein should be construed as not being limitative but being an exemplification at all points. The scope of the disclosure is defined not by the above description of the embodiment but by the appended claims, including all changes and modifications equivalent in sense and range to the claims.

Although the above description has been given on a case in which the disclosure is applied to a monochrome multifunction peripheral as an example, yet the disclosure is not limited to this. Needless to say, the disclosure is also applicable to various types of image forming apparatuses, such as color multifunction peripherals, monochrome printers, color printers, and facsimiles, which include the fixing device having the charge elimination member.

Also, although the foregoing embodiment has been described on a case in which the board 51 with the Zener diode 51*a* attached thereto is used and in which the second contact member 52 is electrically connected to the ground via the Zener diode 51*a*, yet the disclosure is not limited to this. For example, with use of a board 51 having a resistor attached thereto, the second contact member 52 may be electrically connected to the ground via the resistor.

What is claimed is:

1. A fixing device comprising:

a fixing member which includes a heating member and a pressure member to be put into pressure contact with the heating member and which serves for heating and pressurizing a toner image carried on a recording medium to make the toner image fixed on the recording medium;

a fixing housing for housing the fixing member therein;

a charge elimination member which is placed on a downstream side of the fixing member in a recording-medium conveyance direction and which serves for charge elimination from the recording medium by making contact with the recording medium that has passed through a fixing-and-nipping part formed of the heating member and the pressure member;

a retaining member to which the charge elimination member is fixed and which is mounted on the fixing housing;

a contact sheet metal fixed to the fixing housing and held at a specified potential; and a first contact member for electrically connecting the charge elimination member and the contact sheet metal to each other, wherein the retaining member has a positioning boss for mounting the retaining member onto the fixing housing, the fixing housing has an insertion hole into which the positioning boss is to be inserted, the positioning boss is formed into a hollow cylindrical shape, the first contact member is placed inside the positioning boss and has one end protruded from a distal end of the positioning boss, and the contact sheet metal is placed so as to face the distal end of the positioning boss.

2. The fixing device according to claim 1, further comprising a conveyance roller placed on the downstream side of the fixing-and-nipping part in the recording-medium conveyance direction and rotatably supported by the retaining member, wherein the charge elimination member is in contact with a rotating shaft of the conveyance roller.

3. The fixing device according to claim 1, wherein the first contact member is a coil spring, and an end portion of the coil spring on one side closer to the charge elimination member is protruded outward from the retaining member and moreover bent in a direction crossing a protruding direction of the positioning boss.

4. The fixing device according to claim 1, wherein the retaining member serves also as a guide member for guiding the recording medium that has passed through the fixing-and-nipping part.

5. An image forming apparatus which includes the fixing device as defined in claim 1.

6. The image forming apparatus according to claim 5, further comprising:

a mounting member on which the fixing device is to be mounted; and an adjustment mechanism for adjusting a mounting angle of the fixing device to the mounting member by moving a longitudinal one end portion of the fixing device relative to the mounting member in the recording-medium conveyance direction, wherein the mounting member is provided with aboard to which a Zener diode or a resistor is attached, and a second contact member which is set in contact with the board so as to be electrically connected to ground via the Zener diode or the resistor and moreover which is set in contact with the contact sheet metal of the fixing device, and the contact sheet metal is formed so as to be longer in the recording-medium conveyance direction than an adjustment width of the adjustment mechanism.

7. The image forming apparatus according to claim 6, wherein the contact sheet metal is placed at a portion of the fixing device on one side on which the longitudinal one end portion thereof is present.

* * * * *